US007082987B2

(12) United States Patent
Hamilton

(10) Patent No.: US 7,082,987 B2
(45) Date of Patent: Aug. 1, 2006

(54) ROTARY REGENERATIVE HEAT EXCHANGER AND ROTOR THEREFOR

(75) Inventor: John A. Hamilton, Falkirk Scotland (GB)

(73) Assignee: Howden Power Limited (GB)

( * ) Notice: Subject to any disclaimer, the term of this patent is extended or adjusted under 35 U.S.C. 154(b) by 0 days.

(21) Appl. No.: 10/181,322

(22) PCT Filed: Jan. 19, 2001

(86) PCT No.: PCT/GB01/00206

§ 371 (c)(1),
(2), (4) Date: Aug. 12, 2002

(87) PCT Pub. No.: WO01/53767

PCT Pub. Date: Jul. 26, 2001

(65) Prior Publication Data

US 2003/0183365 A1 Oct. 2, 2003

(30) Foreign Application Priority Data

Jan. 19, 2000 (GB) ..... 0001226.0

(51) Int. Cl.
*F23L 15/02* (2006.01)
*F28D 17/00* (2006.01)

(52) U.S. Cl. ..... 165/9; 165/4; 165/8; 165/10

(58) Field of Classification Search ..... 165/4, 165/8, 10
See application file for complete search history.

(56) References Cited

U.S. PATENT DOCUMENTS 1,762,320 A * 6/1930 Wood ..... 165/5
3,216,486 A * 11/1965 Hall et al. ..... 165/9
3,267,562 A * 8/1966 Casagrande et al. ... 29/890.034
3,789,916 A * 2/1974 Lindahl ..... 96/125
3,830,287 A * 8/1974 Eisenstein ..... 165/10
3,874,442 A * 4/1975 Johnsson ..... 165/10
3,968,569 A * 7/1976 Faris ..... 33/655
3,996,997 A * 12/1976 Regan et al. ..... 165/8
4,093,435 A * 6/1978 Marron et al. ..... 96/125
4,209,060 A * 6/1980 Wiking et al. ..... 165/8
4,557,318 A * 12/1985 Bellows ..... 165/10
4,558,732 A * 12/1985 Bellows ..... 165/8
4,561,492 A * 12/1985 Bellows ..... 165/8
4,627,485 A 12/1986 Osborn ..... 165/8
4,838,342 A * 6/1989 Goetschius ..... 165/10
4,911,227 A * 3/1990 Saito et al. ..... 165/10
4,984,621 A * 1/1991 Miller et al. ..... 165/10
5,040,310 A * 8/1991 Huttlin ..... 34/587
5,454,418 A * 10/1995 Brophy et al. ..... 165/8
5,456,310 A * 10/1995 Brophy et al. ..... 165/9

(Continued)

FOREIGN PATENT DOCUMENTS

WO WO 93/19339 9/1993

(Continued)

*Primary Examiner*—Henry Bennett
*Assistant Examiner*—Nihir Patel
(74) *Attorney, Agent, or Firm*—McNair Law Firm, P.A.

(57) ABSTRACT

A rotary regenerative heat exchanger includes a rotor having primary vanes 14 extending between the hub and the periphery of the rotor, and additional secondary vanes 15 between said primary vanes and extending over an outer annulus of the rotor. Such an arrangement facilitates having several of the primary and secondary vanes sealed with respect to a sector plate over the outer annulus as compared with the number of primary vanes sealing with the same sector plate over the inner annulus.

10 Claims, 4 Drawing Sheets

U.S. PATENT DOCUMENTS

| | | | | |
|---|---|---|---|---|
| 5,485,877 | A * | 1/1996 | Brophy | 165/8 |
| 5,577,551 | A | 11/1996 | Kritzler et al. | 165/9 |
| 5,615,732 | A * | 4/1997 | Brophy et al. | 165/8 |
| 5,836,378 | A * | 11/1998 | Brophy et al. | 165/9 |
| 5,915,340 | A * | 6/1999 | Cronin et al. | 122/1 A |
| 6,257,318 | B1 * | 7/2001 | Fierle et al. | 165/8 |
| 6,422,298 | B1 * | 7/2002 | Rhodes et al. | 165/8 |
| 6,505,679 | B1 * | 1/2003 | Larkin et al. | 165/9 |
| 6,672,369 | B1 * | 1/2004 | Brophy et al. | 165/8 |

FOREIGN PATENT DOCUMENTS

| | | |
|---|---|---|
| WO | WO 97/01733 | 1/1997 |
| WO | WO 98/14743 | 4/1998 |

* cited by examiner

ROTARY REGENERATIVE HEAT EXCHANGER AND ROTOR THEREFOR

FIELD OF THE INVENTION

The present application relates to a rotary regenerative heat exchanger, and more particularly to the sealing of the diaphragms or vanes of the rotor relative to the separator plates between different paths of fluid medium through the heat exchanger as the rotor rotates within its housing.

BACKGROUND OF THE INVENTION

Rotary regenerative heat exchangers are well known, and an example of such heat exchanger is described in our EP-A-0599577.

The stator, often termed the rotor housing, includes means for introducing along a first path into the spaces between the radial diaphragms or vanes of the rotor, at least a first fluid which is relatively hot and gives up its heat to heat exchange media contained within those spaces, and a second path for a relatively cool fluid which passes through a different sector of the rotor to recover heat from the heat exchange media in that particular part of the heat exchanger rotor. As the rotor rotates the heated heat exchange media from the first sector passes from the first path to the second path to give up its heat to the relatively cool fluid. Often there will be additional fluid flow paths, for example in the case where the relatively hot fluid is flue gas from a combustion unit and the relatively cool fluid may comprise the combustion gas and secondary air which may pass through the heat exchanger in different sectors of the rotor housing.

In order to prevent transfer of fluid and thermal energy between the zones of differing temperature in the rotor housing or stator, particularly in the case where there may be substantial pressure differences between the fluids flowing through the rotor heat exchange media pockets in the different paths, it is necessary to provide sealing means to ensure that the pockets within the rotor forming part of one sector are sealed from the pockets of an adjacent sector. Where substantial pressure differences arise between the two adjacent pockets in such a system, the sealing effect is frequently enhanced by ensuring that the stator plate past which the seals move, and which separates the one sector from the other, seals simultaneously with two or more of the vanes or diaphragms, thereby giving an enhanced labyrinth sealing effect. However, this has the disadvantage that the dead space between adjacent sectors increases in order to allow several of the diaphragms to seal against the sector plate.

SUMMARY OF THE INVENTION

In accordance with a first aspect of the present invention there is provided a rotary regenerative heat exchanger comprising:—a rotor having a plurality of radial vanes defining between them spaces in which fluid treatment medium is located; a stator forming a housing for the rotor and defining first and further fluid flow paths to and through the rotor in different sectors thereof; sector plates of the stator, extending in the radial direction relative to the rotor axis and serving to separate the heat exchange sectors corresponding to said first and further fluid flow paths; and seal means on said radially extending vanes to seal against said sector plates as the respective rotor vane sweeps in close relationship to said sector plate during rotation of the rotor, characterized in that additional vanes are provided between the first mentioned vanes, over a radially outer annulus of the rotor, said additional vanes including further seals to seal against said sector plates.

Preferably the seal means extend over the edges of the vanes at the end faces of the rotor and also over the edges of the vanes at the radially outer edges.

A second aspect of the invention provides a rotor for a rotary regenerative heat exchanger, comprising:—a hub; a plurality of radially extending vanes defining between them sector-shaped spaces to receive heat exchange media and defining first and second opposed faces of the rotor and an axially extending face between them; and first and second sets of radially extending seals on said rotor to seal with first and second opposed stator plates, respectively, some of said seals extending along each said vane on both the first face and the second face; characterised in that each said set of radially extending seals includes seals extending along secondary vanes between the first mentioned vanes over a radially outer annulus of the rotor but not over a radially inner annulus thereof. In order that the present invention may more readily be understood the following description is given, merely by way of example, with reference to the accompanying drawings in which:

DETAILED DESCRIPTION

Figure 1:
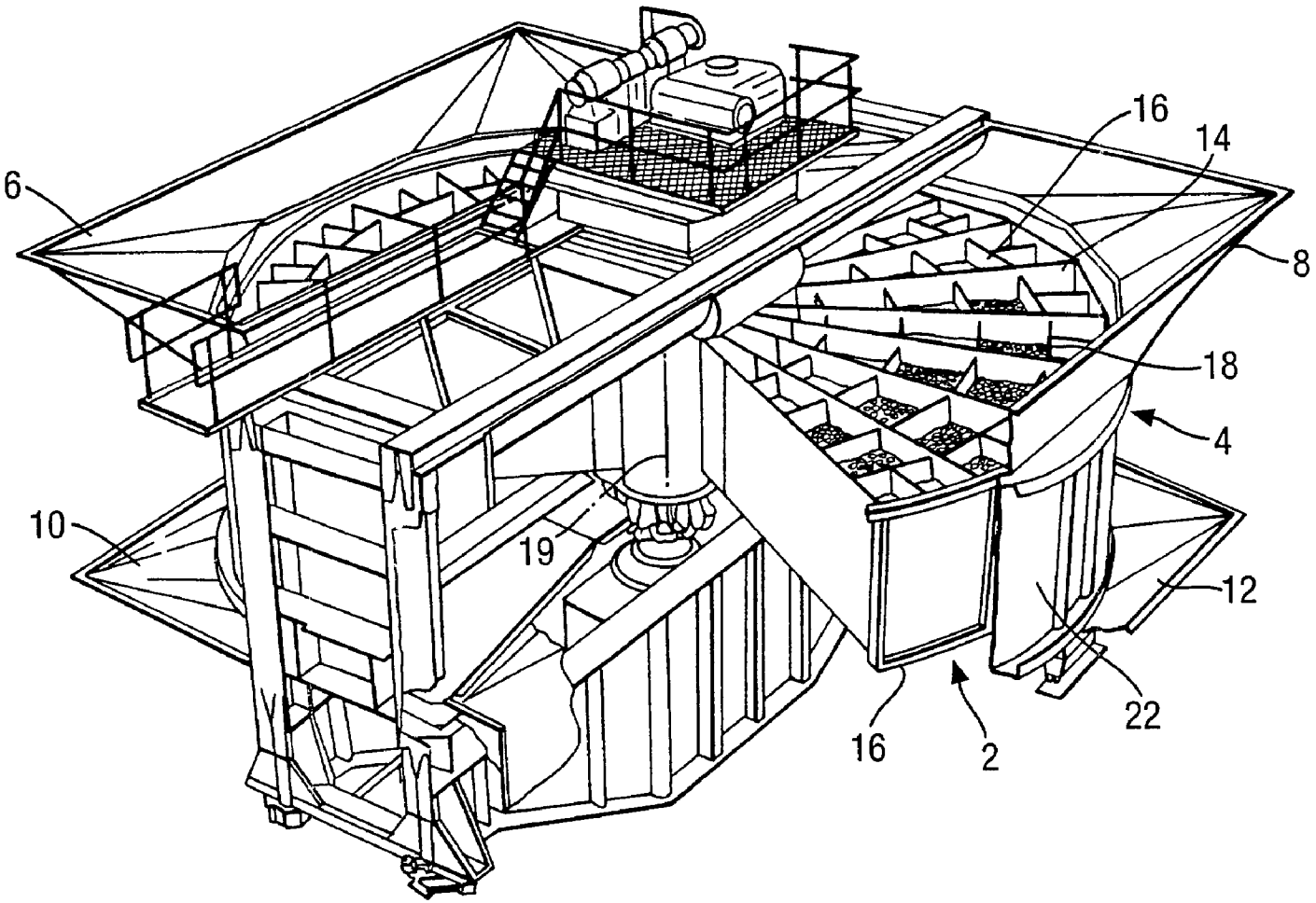
FIG. 1 is a perspective view of a rotor within its housing or stator, and therefore generally illustrates a rotary fluid treatment apparatus, in this case a heat exchanger.

Referring now to the drawings, FIG. 1 shows in perspective a conventional rotary regenerative heat exchanger with a rotor 2 rotating within a housing 4 or stator which is extended at its upper end by first and second gas guidance funnels 6 and 8 and at its lower end by first and second gas guidance funnels 10 and 12, respectively. Although not shown in FIG. 1, there is an isolation between the first gas conduit defined by the funnels 6 and 10 on the lefthand side of the apparatus and a second gas conduit formed by the righthand guide funnels 8 and 12.

The rotor 2 has radially extending vanes 14 which are joined together by transverse plates 16 to define pockets within which is disposed heat exchange media 18 which, during the course of a revolution of the rotor 2 within the housing 4, will pass from a first, heat-receiving, zone where gas is given up to the heat exchange media by a first hot gas flow to a second, heat-relinquishing, zone where the same heat exchange media then gives up its heat to a second cooler gas flow, the two gas flows passing parallel to the axis of rotation 19 of the rotor 2.

Figure 2:
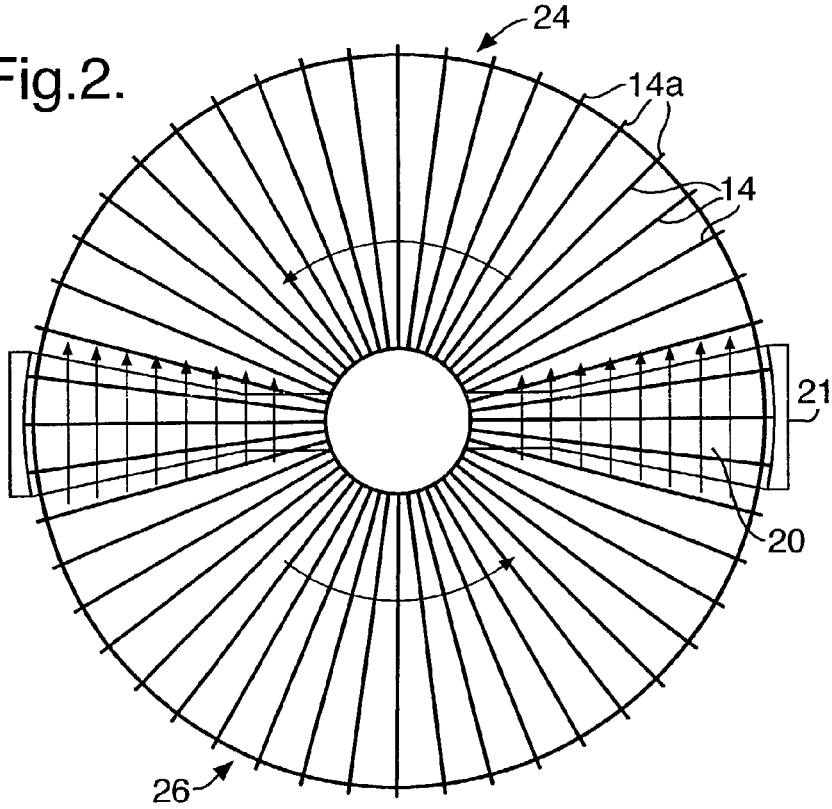
FIG. 2 is a schematic view looking down on the apparatus of FIG. 1 along the direction of the axis of the rotor, and illustrating the rotor vanes and the sector plates of a conventional fluid treatment rotor.

The top plan view shown in FIG. 2 illustrates schematically such a conventional rotor 2 having, in this case, 48 radial vanes each of which will carry a radial seal along its top edge and another along its bottom edge, and an axial seal along its radially outer edge such that there is substantially continuous sealing along and around the entire vane when that vane is in a region between the first and second sectors where the vane is in sealing engagement with a sector plate 20 of the stator. At other times when the vane is passing through one of the two sectors it may optionally still seal along its radially outer edge, against the cylindrical wall 22 (FIG. 1) of the stator housing 4. FIG. 2 shows additional axial seals 14*a* on the radially outer ends of the vanes 14, serving to seal against the concave cylindrical surface of the axial sector plate 21 which extends axially to join the upper sector plate 20 with the lower sector plate 20 (not shown in the drawings).

In practice the rotor 2 will rotate very slowly, often of the order of one revolution per minute. The plan view of FIG. 2 shows at the top of the drawing a first sector 24, in this case in the hotter zone of the apparatus, through which flue gas from a combustion unit passes to give up its heat to the heat exchange media carried by the rotor. The lower sector 26 in FIG. 2 is in the cooler zone where the heat of the heat exchange media is given up to the flow of cool inlet air to the combustion unit. In this case the flue gas will be at a lower pressure than the incoming air which is being supercharged into the combustion unit.

The present invention is implemented in the rotors illustrated in FIGS. 3 to 6.

Figure 3:
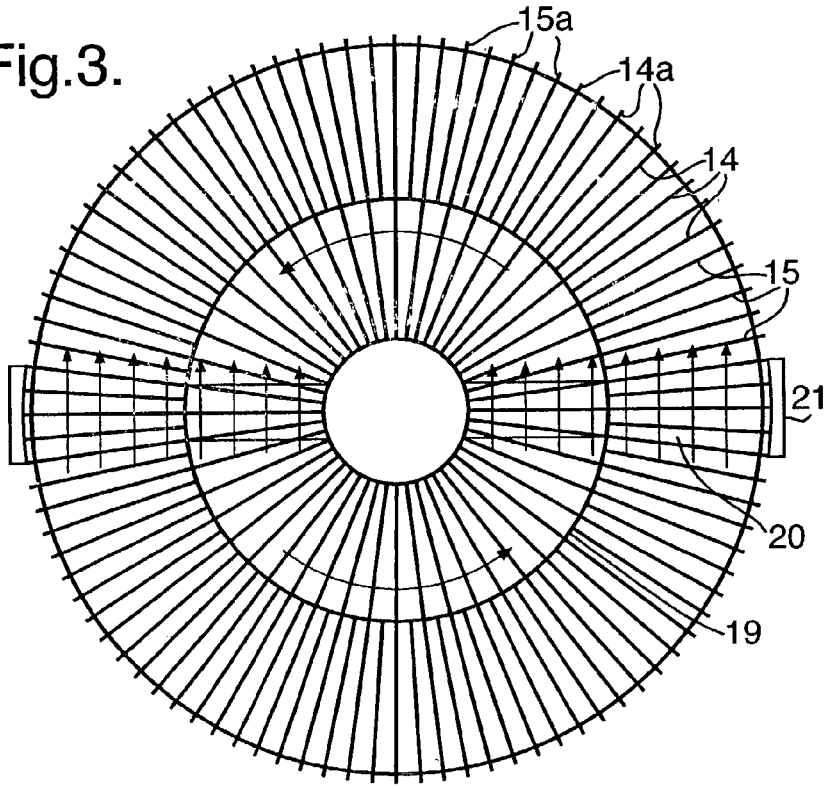
FIG. 3 is a view corresponding to FIG. 2 but showing a first embodiment of rotor according to the present invention.

FIG. 3 shows a first embodiment in which the 48 primary vanes 14 of FIG. 2 are supplemented over an outer annulus of the rotor by secondary vanes 15 each of which is provided with seals at each end of the rotor (top and bottom of the vane as shown in FIG. 3) and an axial seal.

Over the radially inner annulus of the rotor there are no such supplementary vanes. Such supplementary vanes in this region would clutter the rotor and give rise to constructional problems which are avoided by having the secondary vanes 15 over the radially outer annulus.

FIG. 3 shows additionally a circumferentially extending seal 19 on a wall dividing the inner annulus where continuous primary vanes 14 are placed, from the outer annulus to which the additional secondary vanes 15 are confined. This is in order to ensure that there is no gas flow under the sector plate 20 in a radial direction between the inner and outer annuli, and thus the full benefit of the enhanced sealing over the outer annulus can be achieved without being compromised by the sealing using only the primary vanes 14 over the inner annulus. FIG. 3 also shows that there are axially extending seals 15*a* on the secondary vanes 15.

Relative to the shape of the sector plate in FIG. 2, the sector plate 20 of FIG. 3 has a substantially parallel sided region near the hub of the rotor, inboard of the circumferentially extending seal 19, and a divergent section over the radially outer annulus where the secondary vanes 15 are additionally provided.

In the example shown in FIG. 3, the divergent outer portion of the sector plate has an angular extent sufficient to seal simultaneously against four of the vanes 14, 15 of the rotor, whereas the part of the sector plate 20 over the radially inner annulus seals over two of the primary vanes 14. In practice it has been found that the sealing demands in the radially inner annulus are much less critical than those over the radially outer annulus so it is sufficient to have only double sealing on the inner annulus.

It should of course be understood that the number (48) of primary vanes shown in FIGS. 2 and 3 is simply one example, and that likewise the number of secondary vanes (again 48) in FIG. 3 is equally chosen as an example. There may, for example, be more than one secondary vane 15 between two adjacent primary vanes 14, and equally there may be any number of the primary vanes other than the 48 shown.

Figure 4:
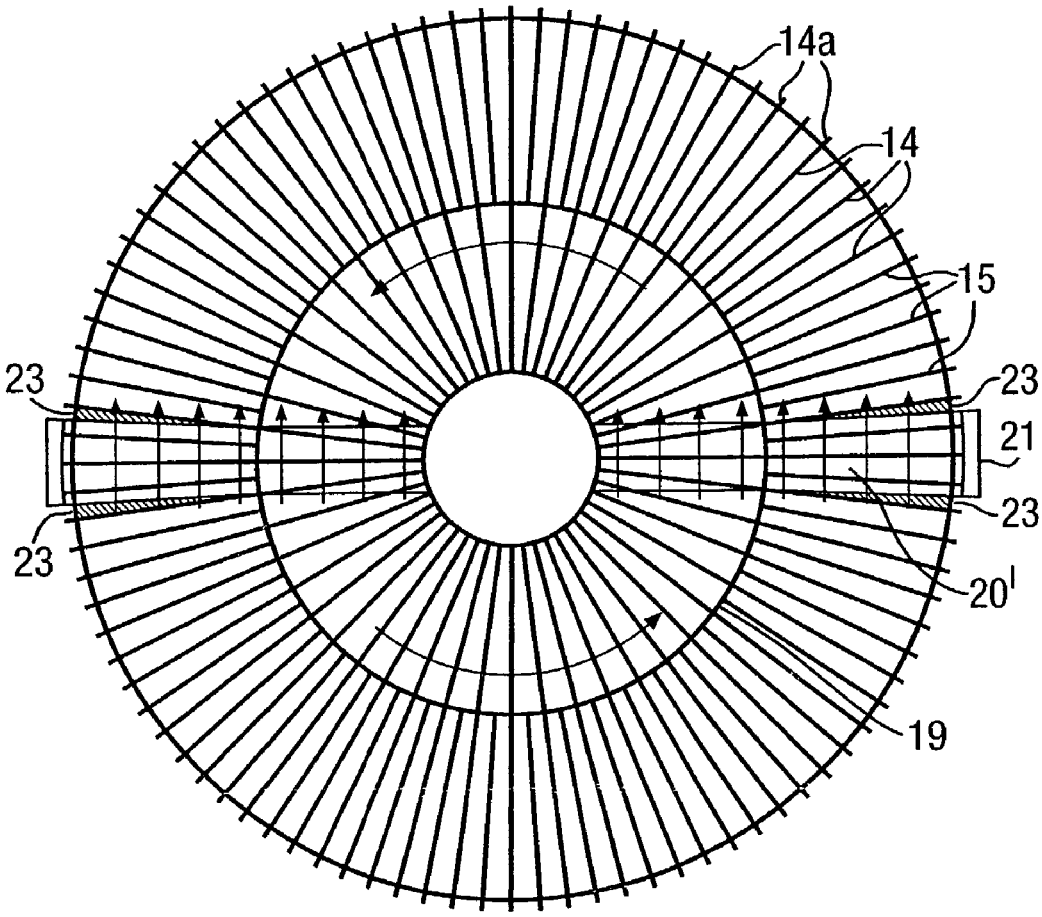
FIG. 4 is a view, similar to FIG. 3, but showing a construction of sector plate having parallel sides over both the inner and outer annuli of the rotor, giving enhanced gas through flow area in the outer annulus.

The modified construction of sector plate 20' in FIG. 4 has the advantage of being able to maximise the gas throughflow passage in the hot (flue gas) sector shown in the upper part of the drawing and the cooler (air) sector shown in the lower half of FIG. 4. As compared with the sector plates 20 of FIG. 3, the sector plates 20' of FIG. 4 have parallel sided construction even over the outer annulus and this liberates an additional region 23 cross-hatched in FIG. 4. This can be achieved without compromising the sealing effect since the seal over the radially inner annulus is double sealing in that at least two of the primary vanes 14 will be in contact with the respective sector plate 20 over their whole radial extent within the inner annulus, and in this case the presence of the secondary vanes 15 provides that over the outer annulus there will be at least three vanes 14, 15 in contact with the respective sector plate over their full radial extent in the outer annulus to give triple sealing.

As a further modification, it would even be possible for the sector plate 20' to have a radially outward tapering construction such that its width at the outer circumference of the rotor is still adequate to maintain triple sealing (sealing with three separate vanes 14, 15 at all times), and thereby increase further the cross-section of the additional areas 23 of FIG. 4, giving rise to still larger flow cross-sections for the gas flow passage and the air flow passage.

Figure 5:
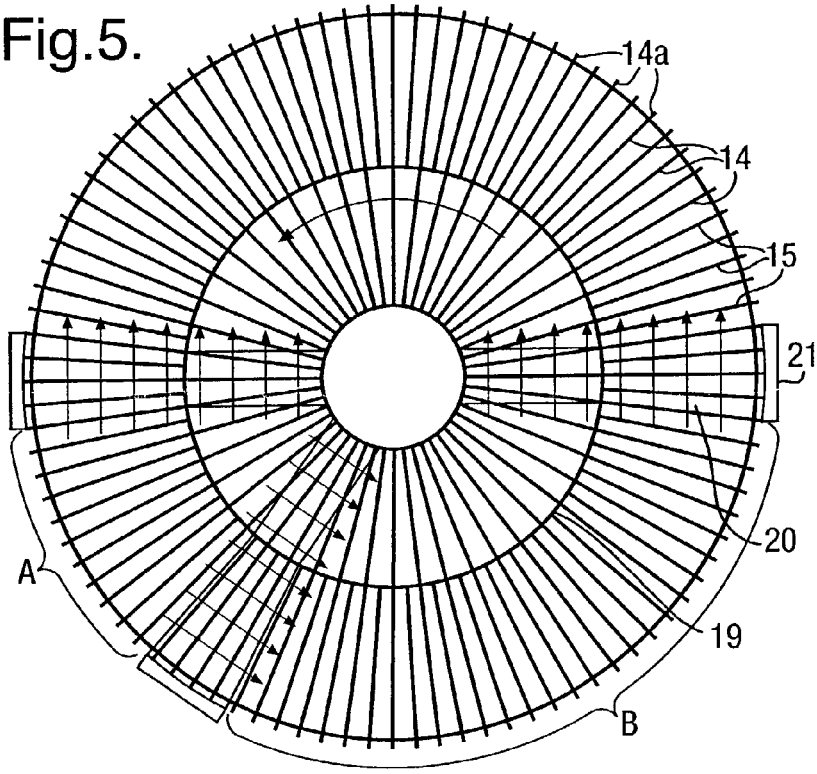
FIG. 5 is a view similar to FIG. 3, but showing a "triple" heat exchanger having the cool air sector divided into two, comprising a minor portion serving as primary air sector at a higher pressure and a major portion serving as a secondary air sector at a minor pressure.

FIG. 5 shows a third embodiment of the present invention and illustrates the configuration where the cooler air zone is divided into two separate air zones, a primary air zone of relatively smaller angular extent and a secondary air sector of relatively larger angular extent.

The embodiment of FIG. 5 is particularly suitable for use with the air flow through a powdered coal burner where the primary air provides a drying and powder-conveying action, the secondary air serves as combustion air, and the flue gas is able to give up its heat in the gas sector.

Figure 6:
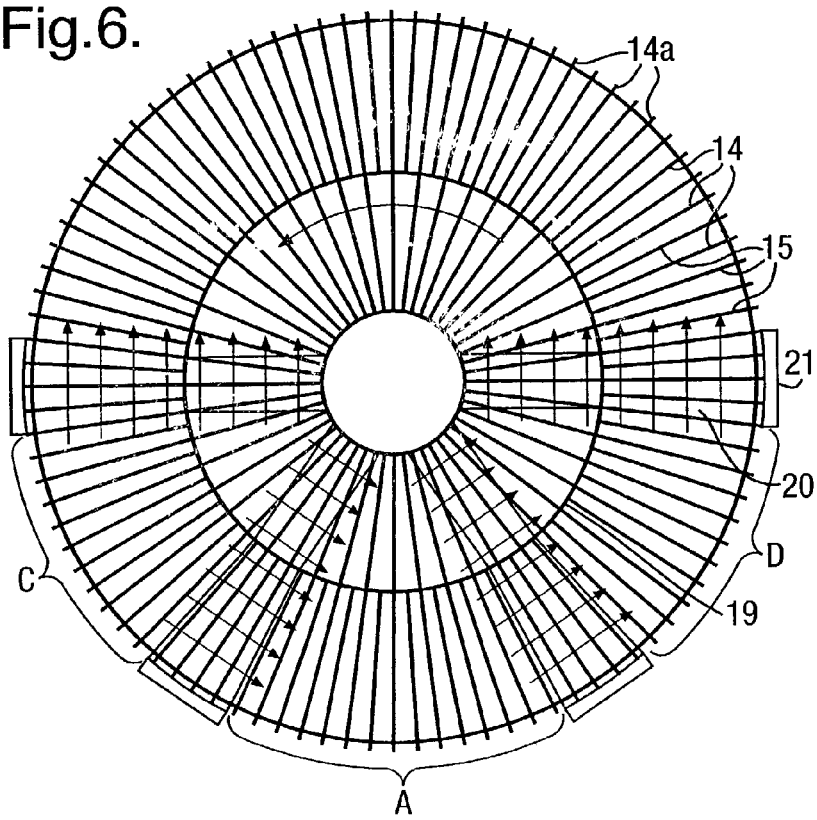
FIG. 6 shows a "quadruple" heat exchanger in which there are two secondary air sectors, one to each side of the primary air sector.

A variation of this arrangement will be shown in FIG. 6 where there are two separate secondary air flow sectors.

The rotor construction of FIG. 5 is also used in FIG. 6, but the stator differs in FIG. 6 in having two secondary air zones which are disposed to either side of the primary air zone and therefore separate the primary air zone from the gas or hot zone.

The configuration of each sector plate 20 in FIG. 3 is repeated in FIGS. 5 and 6, the only difference being that in FIG. 5 there are three such sector plates, because of the three separate zones, and in FIG. 6 there are four such sector plates in view of the four separate zones.

In FIG. 6 the hot zone for the flue gas still occupies preferably half of the angular extent of the rotor whereas the primary zone and the two secondary air zones are of equal angular extent and together occupy the other half of the rotor.

In practice the primary air driven by the high pressure primary fan will make a pass through the primary zone A in FIG. 5 and will then pass to a coal pulverising mill where it will serve to dry the coal and convey it in powdered form to the burner(s) of the boiler. The secondary air driven through the secondary zone B at a somewhat reduced pressure will pass to the burner to serve as combustion air. In the case of FIG. 5 this secondary flow passes through the single secondary sector B whereas in FIG. 6 the secondary air flow will be divided before passing through the two secondary air zones C and D in parallel. Thus in the case of the heat exchanger of FIG. 5 the relatively hot heat exchange media leaving the hot (exhaust gas) zone passes firstly into the primary high pressure air path where it remains for a relatively short time but then passes to the single secondary air path B where it remains in contact with the secondary air for a much longer duration. In the case of FIG. 6 the hot heat exchange media first of all encounters the secondary air at medium pressure in the relatively small cross-section secondary air path C and then passes to the primary air path at much higher pressure and lower temperature in the primary path A, and any residual heat is then given up to the secondary air in the secondary air segment D before the heat exchange media returns to the hot (flue gas) path to be reheated.

Although not shown in FIGS. 2 to 6, in each case the rotor will still include transversely extending plates to brace the structure of the rotor which will be many meters in diameter.

Although the enhancement of the sealing effect through the addition of the secondary vanes 15 is confined to the outer annulus of the heater, this effect is achievable both at the top and the bottom (i.e. the opposite axial faces) of the rotor and also on the circumferential face, due to the axial seal bars and seals.

The leakage effects are normally more pronounced over the outer annulus than over the inner, due to the fact that the running clearances between the rotor sealing vanes and the stationary sector sealing plates will be larger over the outer annulus than over the inner annulus. The larger running clearances over the outer annulus arc a consequence of the thermal 'hogging' or 'capping' of the rotor structure due to the temperature gradient through the depth of the rotor during normal operation.

By enhancing the sealing effect over the outer annulus, this potential cause of leakage can be minimised giving a noticeable improvement in the overall thermal efficiency of the process in which the heat exchanger of the present invention is used.

The invention claimed is:

1. A rotor (2) for a rotary regenerative heat exchanger, comprising:—a hub; a plurality of radially extending vanes (14) defining between them sector-shaped spaces to receive heat exchange media and defining first and second opposed faces of the rotor and an axially extending face between them; and first and second sets of radially extending seals on said rotor (2) to seal with the adjacent face of the respective one of first and second opposed stator plates, respectively, some of said seals extending along each said vane on both the first face and the second face; characterised in that each said set of radially extending seals includes seals extending along secondary vanes (15) between the first mentioned vanes over a radially outer annulus of the rotor but not over a radially inner annulus thereof.

2. A rotor according to claim 1 and including axially extending seals (14*a*, 15*a*) on the radially outer surface of each primary (14) and secondary (15) vane.

3. A rotor according to claim 1, wherein there are at least two secondary vanes (15) disposed between the adjacent successive primary (14) vanes of the rotor.

4. A rotor according to claim 1, and including a circumferentially extending wall separating the inner annulus from the outer and extending between said opposed first and second faces of the rotor, and continuous seals (19) on said circumferentially extending wall at said first face and at said second face of the rotor.

5. A rotary regenerative heat exchanger comprising:—a rotor (2) having a plurality of radial vanes (14) defining between them spaces in which fluid treatment medium is located; a stator (14) forming a housing for the rotor and defining first and further fluid flow paths to and through the rotor in different sectors thereof; sector plates (20) of the stator, extending in the radial direction relative to the rotor axis and serving to separate the heat exchange sectors corresponding to said first and further fluid flow paths; and seal means on said radially extending vanes to seal against the adjacent surface of a respective one of said sector plates as the respective rotor vane sweeps in close relationship to said sector plate surface during rotation of the rotor, characterized in that additional vanes (15) are provided between the first mentioned vanes, over a radially outer annulus of the rotor, said additional vanes including further seals to seal against said sector plate surfaces.

6. A rotary regenerative heat exchanger according to claim 5, wherein the further fluid paths are second and third separated paths; wherein there are first said sector plates bounding the first path for hot gas through the rotor to impart heat to heat exchange media within the sector of the rotor in register with said first path, and further said sector plates defining said second and third paths for fluid through heat exchange media in the sectors of the rotor in register with said further paths; and wherein said first sector plates divide the first fluid path from said second and third fluid paths and the further sector plates separate said second and third fluid paths from one another.

7. A rotary regenerative heat exchanger according to claim 5, wherein said further fluid flow paths comprise second, third and fourth paths, and wherein first said sector plates separate said first fluid path from second and third fluid paths through the rotor, and a first set of said further sector plates separates said second fluid path from said fourth fluid path and a second set of said further sector plates separates said third fluid path from said fourth fluid path.

8. A heat exchanger according to claim 5, wherein the or each sector plate is substantially parallel-sided over substantially the whole of the extent from the rotor hub to the periphery.

9. A heat exchanger according to claim 5, wherein the width of a said sector plate decreases towards the periphery of the rotor.

10. A heat exchanger according to claim 5, wherein the sector plates are shaped to provide sealing contact simultaneously with more of the first mentioned and secondary vanes in said outer annulus than they seal with the first mentioned vanes over the inner annulus.

* * * * *